US009041300B2

(12) United States Patent
Qing et al.

(10) Patent No.: US 9,041,300 B2
(45) Date of Patent: May 26, 2015

(54) DRIVING CIRCUIT AND METHOD FOR PIXEL UNIT, PIXEL UNIT AND DISPLAY APPARATUS

(71) Applicants: BOE TECHNOLOGY GROUP CO., LTD., Beijing (CN); CHENGDU BOE OPTOELECTRONICS TECHNOLOGY CO., LTD., Chengdu, Sichuan (CN)

(72) Inventors: Haigang Qing, Beijing (CN); Xiaojing Qi, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu, Sichuan (CN)

( * ) Notice: Subject to any disclaimer, the term of this patent is extended or adjusted under 35 U.S.C. 154(b) by 0 days.

(21) Appl. No.: 13/994,946

(22) PCT Filed: Nov. 30, 2012

(86) PCT No.: PCT/CN2012/085693
§ 371 (c)(1),
(2) Date: Jun. 17, 2013

(87) PCT Pub. No.: WO2013/159523
PCT Pub. Date: Oct. 31, 2013

(65) Prior Publication Data

US 2014/0117862 A1 May 1, 2014

(30) Foreign Application Priority Data

Apr. 28, 2012 (CN) ..... 2012 1 0133100

(51) Int. Cl.
*H05B 37/02* (2006.01)
*G09G 3/30* (2006.01)
*G09G 3/32* (2006.01)

(52) U.S. Cl.
CPC ..... *G09G 3/3225* (2013.01); *G09G 3/30* (2013.01); *G09G 3/32* (2013.01)

(58) Field of Classification Search
CPC ..... G09G 3/3225; G09G 3/30; H05B 37/02
USPC ..... 315/172, 151; 345/76, 92
See application file for complete search history.

(56) References Cited

U.S. PATENT DOCUMENTS 6,859,193 B1 * 2/2005 Yumoto ..... 345/82
7,046,240 B2 * 5/2006 Kimura ..... 345/212

(Continued)

FOREIGN PATENT DOCUMENTS

CN 101227775 A 7/2008
CN 102708786 A 10/2012

(Continued)

OTHER PUBLICATIONS

International Preliminary Report on Patentability Appln. No. PCT/CN2012/085893; Dated Oct. 28, 2014.

(Continued)

*Primary Examiner* — Douglas W Owens
*Assistant Examiner* — Wei Chan
(74) *Attorney, Agent, or Firm* — Ladas & Parry LLP

(57) ABSTRACT

A driving circuit and method for a pixel unit, the pixel unit and a display apparatus. The driving circuit for the pixel unit includes a switching unit, a storage capacitor (Cst), a first transistor (T1), a second transistor (T2) and a sixth transistor (T6). The switching unit includes a third transistor (T3), a fourth transistor (T4) and a fifth transistor (T5) for controlling a data signal current (Idata) to charge the storage capacitor (Cst). The driving circuit for the pixel unit expedites the speed for charging the storage capacitor (Cst); further, it has an excellent negative feedback function for the leak current of the storage capacitor (Cst), and ensures the stable operation of the circuit.

12 Claims, 7 Drawing Sheets

(56) References Cited

U.S. PATENT DOCUMENTS

| | | | | |
|---|---|---|---|---|
| 7,414,599 | B2 * | 8/2008 | Chung et al. | 345/76 |
| 7,773,054 | B2 * | 8/2010 | Jeong | 345/76 |
| 7,795,618 | B2 * | 9/2010 | Yamazaki et al. | 257/59 |
| 7,800,556 | B2 * | 9/2010 | Chen et al. | 345/76 |
| 7,800,564 | B2 * | 9/2010 | Numao | 345/82 |
| 8,049,684 | B2 * | 11/2011 | Kim | 345/76 |
| 8,482,491 | B2 * | 7/2013 | Kimura | 345/76 |
| 2003/0174152 | A1 * | 9/2003 | Noguchi | 345/690 |
| 2004/0056828 | A1 * | 3/2004 | Choi et al. | 345/82 |
| 2005/0200300 | A1 * | 9/2005 | Yumoto | 315/169.1 |
| 2006/0063298 | A1 * | 3/2006 | Winters | 438/99 |
| 2006/0139259 | A1 | 6/2006 | Choi et al. | |
| 2006/0220581 | A1 * | 10/2006 | Yamazaki et al. | 315/169.3 |
| 2006/0232521 | A1 * | 10/2006 | Jang et al. | 345/76 |
| 2006/0267509 | A1 * | 11/2006 | Yang | 315/169.3 |
| 2007/0268220 | A1 * | 11/2007 | Lee et al. | 345/76 |
| 2007/0296671 | A1 * | 12/2007 | Han et al. | 345/92 |
| 2008/0106208 | A1 * | 5/2008 | Choi et al. | 315/169.3 |
| 2008/0170053 | A1 * | 7/2008 | Chiou | 345/205 |
| 2008/0238327 | A1 * | 10/2008 | Cho et al. | 315/169.3 |
| 2011/0069099 | A1 * | 3/2011 | Sun | 345/698 |
| 2011/0234734 | A1 * | 9/2011 | Nagumo | 347/132 |
| 2012/0161637 | A1 * | 6/2012 | Lee et al. | 315/122 |
| 2013/0043796 | A1 * | 2/2013 | Ko et al. | 315/151 |
| 2013/0069537 | A1 * | 3/2013 | Sun et al. | 315/123 |

FOREIGN PATENT DOCUMENTS

| | | | |
|---|---|---|---|
| CN | 102708798 | A | 10/2012 |
| KR | 20070000831 | A | 1/2007 |

OTHER PUBLICATIONS

Second Chinese Office Action dated Jun. 26, 2014; Appln. No. 201210133100.2.

International Search Report Issued Feb. 20, 2013 Appln. No. PCT/CN2012/085693.

First Chinese Office Action Issued Oct. 11, 2013 Appln. No. 201210133100.2.

* cited by examiner

DRIVING CIRCUIT AND METHOD FOR PIXEL UNIT, PIXEL UNIT AND DISPLAY APPARATUS

TECHNICAL FIELD OF DISCLOSURE

This disclosure relates to the technical field of display driving, and in particular, to a driving circuit and method for a pixel unit, the pixel unit and a display apparatus.

BACKGROUND

An AMOLED (Active Matrix Organic Light-Emitting Diode) is able to emit light as it is driven by a current generated by a driving TFT in saturation; that is to say, the AMOLED is driven by the current to emit light. FIG. 1A is a schematic diagram showing a pixel structure of an AMOLED of an existing elementary current type, and FIG. 1B is a timing sequence chart corresponding to the same. As shown in FIG. 1A, the pixel structure of the AMOLED of the existing elementary current type includes an OLED (Organic Light-Emitting Diode), transistors T1, T2, T3, and T4, and a storage capacitor Cst, wherein T1 is a driving thin film transistor, T2, T3 and T4 are controlling thin film transistors; a gate of T2 and a gate of T3 are connected to a control line for outputting a control signal CN1, and a gate of T4 is connected to a control line for outputting a control signal CN2. A driving current Idata is directly applied to the pixel structure of the AMOLED of the existing elementary current type externally to determine a voltage across the storage capacitor Cst, thus generating a driving current Ioled for driving the OLED to emit light. In the pixel structure of the AMOLED of the existing elementary current type, Ioled is equal to Idata, and since bled must be in the range of the operating current of the OLED, i.e., Ioled must be a relatively small current, Idata should be relatively small. As the storage capacitor Cst is a large capacitor, the speed for charging the storage capacitor Cst is relatively slow; especially at a low grey level, it takes a long time to charge the storage capacitor Cst. Therefore, the pixel structure of the AMOLED of the existing elementary current type is not suitable for an AMOLED display of high definition and high refresh frequency.

SUMMARY

The embodiments of the present disclosure provide a driving circuit and method for a pixel unit, the pixel unit and a display apparatus, for solving the problem that the current driving technique for the pixel unit is not suitable for an AMOLED display of high definition and high refresh frequency since such a driving technique causes a relatively slow speed for charging the storage capacitor Cst; especially at a low grey level, it takes a long time to charge the storage capacitor Cst.

An embodiment of the present disclosure provides a driving circuit for a pixel unit including:

a light-emitting device with a first terminal connected to a first level;

a sixth transistor with a drain connected to a second terminal of the light-emitting device;

a first transistor with a drain connected to a source of the sixth transistor and a source connected to a second level;

a storage capacitor with a first terminal connected to a gate of the first transistor, a first control node and a third control node respectively and a second terminal connected to the second level;

a second transistor with a source connected to the second level and a gate connected to the third control node; and a switching unit, being connected to a data signal terminal for supplying a data signal current, a scan signal terminal for supplying a scan signal, the first control node, the third control node and a drain of the second transistor respectively, and further being connected to the source of the sixth transistor via a second control node, for controlling the data signal current to charge the storage capacitor.

In an example, the switching unit comprises a third transistor, a fourth transistor and a fifth transistor, wherein:

the third transistor has a source connected to the third control node, a drain connected to the second control node, and a gate connected to the scan signal terminal;

the fourth transistor has a source connected to the second control node, a drain connected to the data signal terminal, and a gate connected to the scan signal terminal; and the fifth transistor has a source connected to the first control node, a drain connected to the data signal terminal, and a gate connected to the scan signal terminal.

In an example, the first, second, and sixth transistors have equal threshold voltages.

In an example, the first, second, third, fourth, fifth and sixth transistors are of N type thin film transistors; the first level is a high level, and the second level is a low level; the first terminal of the light-emitting device is an anode of the light-emitting device, and the second terminal of the light-emitting device is a cathode of the light-emitting device.

In another example, the first, second, third, fourth, fifth and sixth transistors are of P type thin film transistors; the first level is a low level, and the second level is a high level; the first terminal of the light-emitting device is a cathode of the light-emitting device, and the second terminal of the light-emitting device is an anode of the light-emitting device.

In a further example, the first, second, and sixth transistors are of N type thin film transistors, and the third, fourth and fifth transistors are of P type thin film transistors; the first level is a high level, and the second level is a low level; the first terminal of the light-emitting device is an anode of the light-emitting device, and the second terminal of the light-emitting device is a cathode of the light-emitting device.

In another example, the first, second, and sixth transistors are of P type thin film transistors, and the third, fourth and fifth transistors are of N type thin film transistors; the first level is a high level, and the second level is a low level; the first terminal of the light-emitting device is a cathode of the light-emitting device, and the second terminal of the light-emitting device is an anode of the light-emitting device.

In an example, the light-emitting device is an EL or an OLED.

An embodiment of the present disclosure provides a driving method for a pixel unit, which is applied to the driving circuit for the pixel unit, and the driving method comprising:

step for charging the pixel unit: turning on a switch for controlling the data signal current to charge the storage capacitor until the voltage across the storage capacitor does not rise any more;

step for the light-emitting device emitting light: turning off the switch for controlling the data signal current, and turning on a switch for controlling the light-emitting device to make the light-emitting device to emit light, wherein the current flowing through the light-emitting device is in direct proportion to the data signal current.

In an example, the current flowing through the light-emitting device is equal to the sum of the current flowing through the first transistor and that flowing through the second transistor in the driving circuit for the pixel unit.

An embodiment of the present disclosure provides a pixel unit including the driving circuit for pixel unit as mentioned above.

An embodiment of the present disclosure provides a display apparatus including a plurality of the pixel units as mentioned above.

Compared to the prior art, the driving circuit and method for the pixel unit, the pixel unit and the display apparatus provided by the embodiments of the present disclosure can enable a relatively large scale ratio of the data signal current Idata to the current Ioled flowing through the light-emitting device, which ensures that Ioled is in the range of the operating current of the light-emitting device and expedites the speed for charging the storage capacitor since Idata can be a relatively large current. In addition, for the leak current of the storage capacitor Cst, the driving circuit and method for the pixel unit, the pixel unit and the display apparatus provided by the embodiments of the present disclosure have an excellent negative feedback function and thus ensure the stable operation of the circuit.

DETAILED DESCRIPTION OF THE PREFERRED EMBODIMENTS

Hereinafter, in order to make the technical problem to be solved, the technical solutions and the advantages of the embodiments of the present disclosure clearer, detailed descriptions will be given by combining the accompanying drawings with the detailed embodiments of the present disclosure.

Figure 1A:
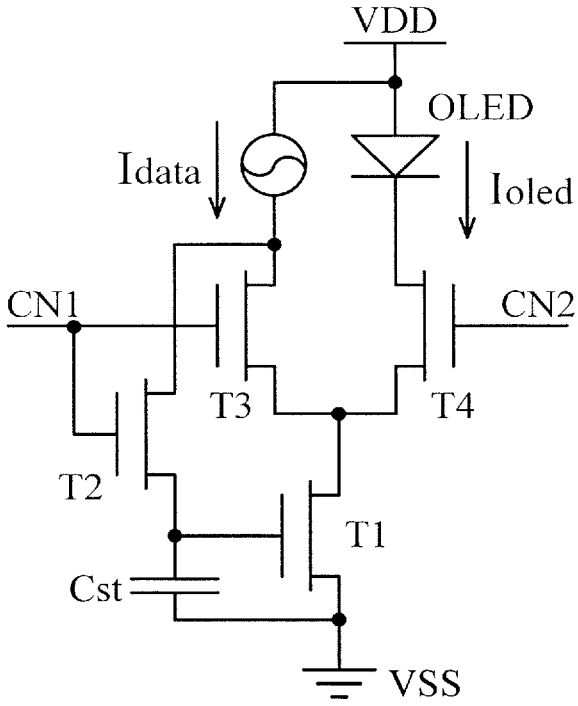
FIG. 1A is a schematic diagram of the pixel circuit structure of an AMOLED of the existing elementary current type.
Figure 1B:
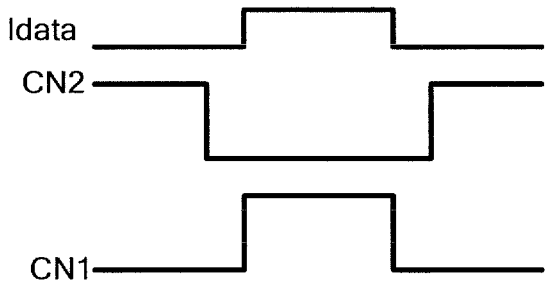
FIG. 1B is a timing sequence chart of the pixel circuit structure shown in FIG. 1A.
Figure 2:
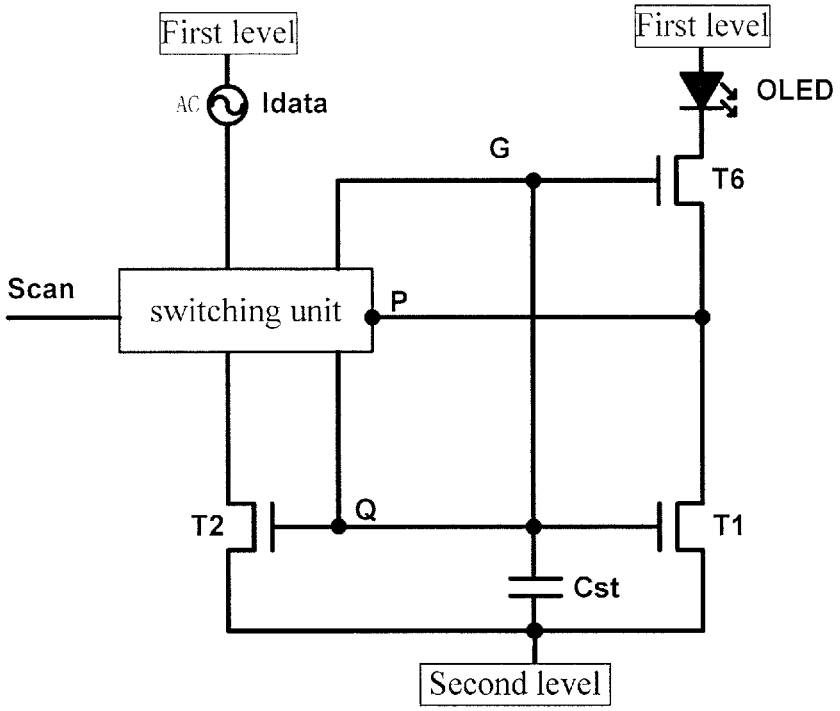
FIG. 2 is a schematic block diagram of a driving circuit for a pixel unit according to an embodiment of the present disclosure.

As shown in FIG. 2, an embodiment of the present disclosure provides a driving circuit for a pixel unit comprising:

a light-emitting device (in FIG. 2, an OLED is taken as an example of the light-emitting device) with a first terminal connected to a first level;

a sixth transistor T6 with a drain connected to a second terminal of the light-emitting device;

a first transistor T1 with a drain connected to a source of the sixth transistor T6 and a source connected to a second level;

a storage capacitor Cst with a first terminal connected to a gate of the first transistor T1, a first control node G and a third control node Q respectively and a second terminal connected to the second level;

a second transistor T2 with a source connected to the second level and a gate connected to the third control node G; and a switching unit, being connected to a data signal terminal Idata for supplying a data signal current, a scan signal terminal Scan for supplying a scan signal, the first control node G, the third control node Q and a drain of the second transistor T2 respectively, and further being connected to the source of the sixth transistor T6 via a second control node P, for controlling the data signal current to charge the storage capacitor Cst.

Figure 3A:
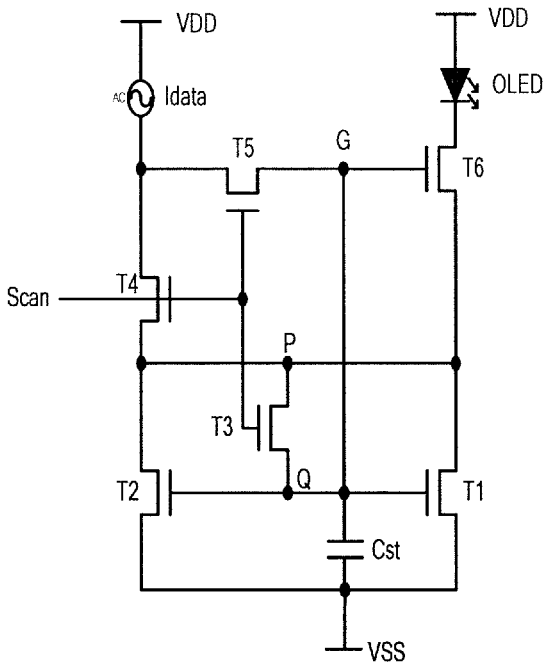
FIG. 3A is a circuit diagram of a first example of the driving circuit for a pixel unit according to an embodiment of the present disclosure.
Figure 4A:
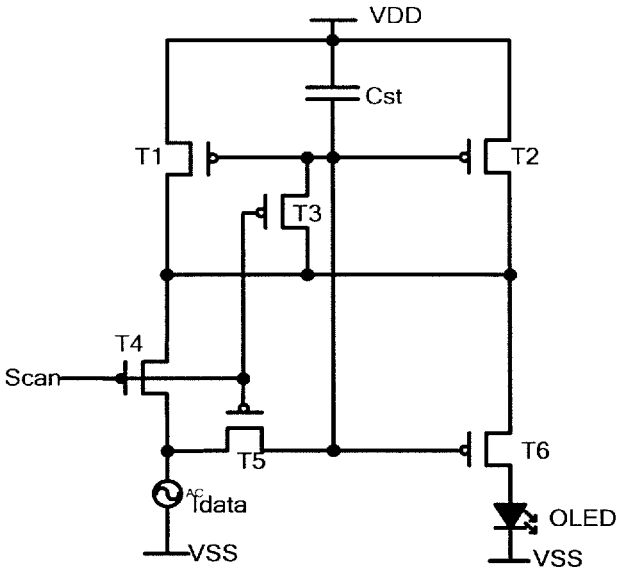
FIG. 4A is a circuit diagram of a second example of the driving circuit for a pixel unit according to another embodiment of the present disclosure.
Figure 5A:
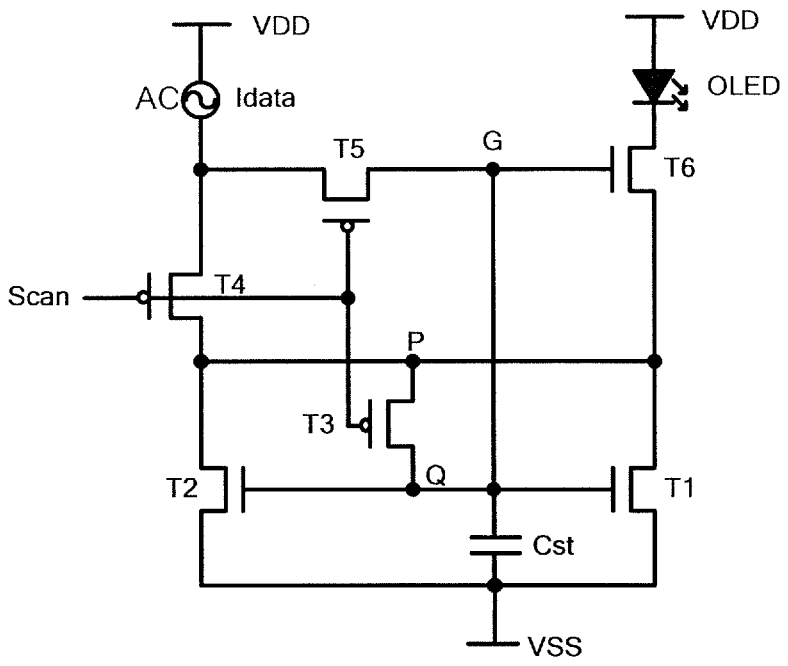
FIG. 5A is a circuit diagram of a third example of the driving circuit for a pixel unit according to an embodiment of the present disclosure.

In an embodiment of the present disclosure, examples are shown in FIG. 3A, FIG. 4A or FIG. 5A, wherein the switching unit includes a third transistor T3, a fourth transistor T4 and a fifth transistor T5, wherein:

the third transistor T3 has a source connected to the third control node Q, a drain connected to the second control node P, and a gate connected to the scan signal terminal Scan;

the fourth transistor T4 has a source connected to the second control node P, a drain connected to the data signal terminal Idata, and a gate connected to the scan signal terminal Scan; and the fifth transistor T5 has a source connected to the first control node G, a drain connected to the data signal terminal Idata, and a gate connected to the scan signal terminal Scan.

Figure 3B:
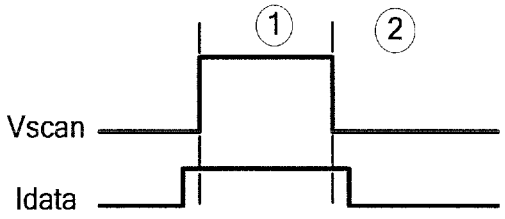
FIG. 3B is a timing sequence chart of the circuit shown in FIG. 3A.

In a first example, as shown in FIG. 3A, the first, second, third, fourth, fifth and sixth transistors T1, T2, T3, T4, T5 and T6 are of N type thin film transistors; meanwhile, the first level is a high level VDD, and the second level is a low level VSS; the first terminal of the light-emitting device is an anode of the light-emitting device, and the second terminal of the light-emitting device is a cathode of the light-emitting device. In such a case, the light-emitting device is a top emitting device. FIG. 3B is a timing sequence chart of the driving circuit for a pixel unit shown in FIG. 3A when driving the pixel unit, wherein the signal ① in FIG. 3B corresponds to the charging stage of the storage capacitor Cst, and the signal ② corresponds to the light-emitting stage of the light-emitting device.

Figure 4B:
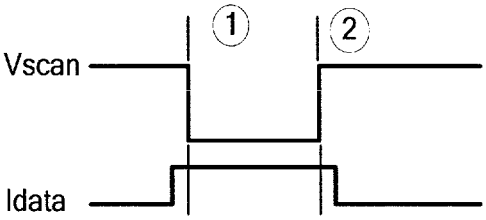
FIG. 4B is a timing sequence chart of the circuit shown in FIG. 4A.

In a second example, as shown in FIG. 4A, the first, second, third, fourth, fifth and sixth transistors T1, T2, T3, T4, T5 and T6 can also be of P type thin film transistors; meanwhile, the first level is a low level VSS, and the second level is a high level VDD; the first terminal of the light-emitting device is a cathode of the light-emitting device, and the second terminal of the light-emitting device is an anode of the light-emitting device. In such a case, the light-emitting device is a bottom emitting device. FIG. 4B is a timing sequence chart of the driving circuit for the pixel unit shown in FIG. 4A when driving the pixel unit, wherein the signal ① in FIG. 4B corresponds to the charging stage of the storage capacitor Cst, and the signal ② corresponds to the light-emitting stage of the light-emitting device.

In a third example, as shown in FIG. 5A, the first, second, and sixth transistors T1, T2, and T6 are of N type thin film transistors, and the third, fourth and fifth transistors T3, T4 and T5 are of P type thin film transistors; meanwhile, the first level is a high level VDD, and the second level is a low level VSS; the first terminal of the light-emitting device is an anode of the light-emitting device, and the second terminal of the light-emitting device is a cathode of the light-emitting device.

Figure 5B:
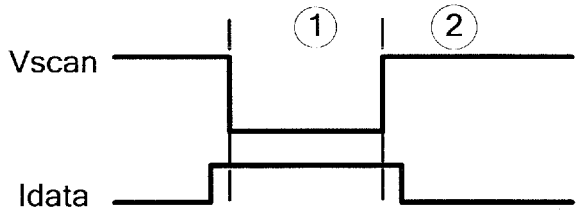
FIG. 5B is a timing sequence chart of the circuit shown in FIG. 5A.

FIG. 5B is a timing sequence chart of the driving circuit for the pixel unit shown in FIG. 5A when driving the pixel unit, wherein the signal ① in FIG. 5B corresponds to the charging stage of the storage capacitor Cst, and the signal ② corresponds to the light-emitting stage of the light-emitting device.

In a fourth example, the first, second, and sixth transistors T1, T2, and T6 are of P type thin film transistors, and the third, fourth and fifth transistors T3, T4 and T5 are of N type thin film transistors; meanwhile, the first level is a high level VDD, and the second level is a low level VSS; the first terminal of the light-emitting device is a cathode of the light-emitting device, and the second terminal of the light-emitting device is an anode of the light-emitting device (not shown in the drawings).

Besides the above forms of the low temperature polysilicon (LTPS) transistors, the first, second, third, fourth, fifth and sixth transistors T1, T2, T3, T4, T5 and T6 can also be of oxide transistors, oxide TFTs, organic transistors or organic TFTs.

The light-emitting device can be of EL, OLED and the like.

In an example, the first, second, and sixth transistors T1, T2, and T6 have equal threshold voltages. For instance, if an ELA (Excimer Laser Annealing) process is employed, the first, second and sixth transistors T1, T2 and T6 can be placed on a same horizontal position within one pixel when the layout of the pixel circuit is designed, so that these three transistors can be located within the same horizontal laser beam in manufacturing process to ensure the threshold voltage Vth1 of the first transistor T1, the threshold voltage Vth2 of the second transistor T2, and the threshold voltage Vth6 of the sixth transistor T6 to be equal and thus to be considered as Vth.

In the above driving circuits for the pixel unit, the definitions of the source and the drain of the transistor are not fixed, and they vary with the variation of the voltages. For an N type thin film transistor, a drain is arranged at a location of high voltage, and a source is arranged at a location of low voltage; the case is contrary for a P type thin film transistor.

In addition, an embodiment of the present disclosure further provides a driving method for a pixel unit, which is applied to the above driving circuit for the pixel unit provided by the embodiment of the present disclosure, and the driving method comprises two steps of A1-A2 as follows:

The step A1 is for charging the pixel unit: controlling the data signal current Idata to charge the storage capacitor Cst until the voltage across the storage capacitor Cst does not rise any more; at this time, no data current flows into the storage capacitor Cst, and the voltage across the storage capacitor corresponds to the data current flowing through the transistor under the control.

Wherein, the first transistor T1 and the second transistor T2 are in saturation, and the sum of the saturation current of the first transistor T1 and that of the second transistor T2 is equal to the data signal current Idata.

That is, the step A1 can be implemented as follows: turning on a switch for controlling the data signal current, and using the data signal current Idata to charge the storage capacitor Cst until the sum of the saturation current of the first transistor T1 and that of the second transistor T2 is equal to the data signal current Idata.

The step A2 is for the light-emitting device emitting light: turning off the switch for controlling the data signal current, and meantime turning on a switch for controlling the light-emitting device so that the current Ioled flowing through the light-emitting device is in direct proportion to the data signal current Idata.

Wherein, the step A2 can be implemented as follows:

turning off the switch for controlling the data signal current, and meantime turning on the switch for controlling the light-emitting device, so that the first transistor T1 and the second transistor T2 operate in a linear operating area and the current flowing through the light-emitting device is equal to the sum of the current flowing through the first transistor T1 and that flowing through the second transistor T2.

The above steps of A1-A2 can be carried out by the switching unit and the corresponding transistors in the above driving circuit for the pixel unit provided by the embodiments of the present disclosure. Hereinafter, detailed descriptions will be given to the operating principle of the driving circuit for the pixel unit provided by the embodiment of the present disclosure by taking FIG. 3A as an example.

A first stage is the stage for charging the storage capacitor Cst.

Figure 6:
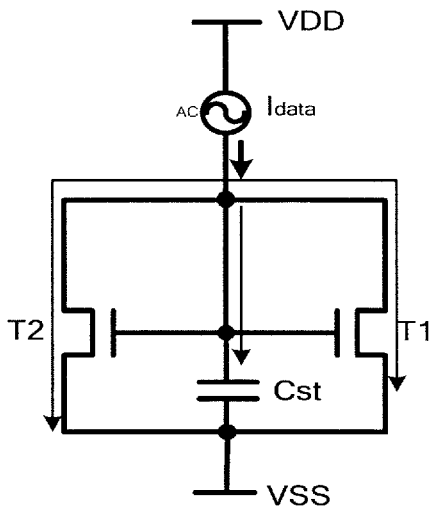
FIG. 6 is an equivalent circuit diagram of the circuit shown in FIG. 3A in a first stage.

FIG. 3B is a timing sequence chart of the driving circuit for the pixel unit as shown in FIG. 3A. FIG. 6 is an equivalent circuit diagram of the driving circuit for the pixel unit shown in FIG. 3B when the storage capacitor Cst is being charged. FIG. 6 corresponds to the signal ① shown in FIG. 3B.

With reference to FIG. 3A (only the circuit structure is shown in FIG. 3A, but the states of the individual transistors when being turned on are not shown), the third, fourth, and fifth thin film transistors T3, T4, and T5 are turned on, and the data signal current Idata charges the storage capacitor Cst via the node G.

At this time, the node G and node P are connected together, and the gate-source voltage of the sixth thin film transistor T6 is equal to 0, and thus the sixth thin film transistor T6 is turned off. Meanwhile, the node P and node Q are connected together, and the first thin film transistor T1 and the second thin film transistor T2 serve as diodes, and the individual voltage values of the first thin film transistor T1 and the second thin film transistor T2 have the following relationship:

$$Vgs=Vds=Vst=Vg-VSS$$

wherein, Vgs represents the gate-source voltage of a thin film transistor, Vds represents the source-drain voltage of the thin film transistor, Vst represents the voltage across the storage capacitor, and Vg represents the voltage at node G.

At this time, both the first thin film transistor T1 and the second thin film transistor T2 are in saturation.

After the storage capacitor Cst is charged, the following relationship holds true:

$$I_{data}=I_{ds1}+I_{ds2}$$

wherein $I_{ds1}$ denotes the saturation current of the first thin film transistor T1, and $I_{ds2}$ denotes the saturation current of the second thin film transistor T2.

For the first thin film transistor T1, the following relationship holds true:

$$I_{ds1} = \frac{1}{2}k_1(V_{gs} - V_{th})^2 \quad (1)$$

wherein $k_1$ denotes a constant relating to the design size and the process of the first thin film transistor T1.

For the second thin film transistor T2, the following relationship holds true:

$$I_{ds2} = \frac{1}{2}k_2(V_{gs} - V_{th})^2 \quad (2)$$

wherein $k_2$ denotes a constant relating to the design size and the process of the second thin film transistor T2.

It can be obtained from the above equations (1) and (2):

$$\frac{I_{ds1}}{I_{ds2}} = \frac{k_1}{k_2}$$

It can be obtained by combining the above equations:

$$I_{ds1} = \frac{k_1 Idata}{k_1 + k_2} \tag{3}$$

A second stage is the stage for the light-emitting device emitting light.

Figure 7:
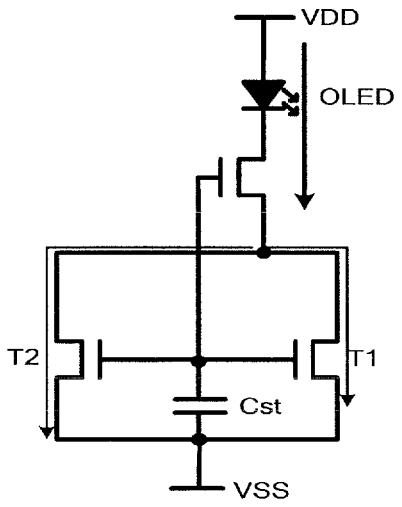
FIG. 7 is an equivalent circuit diagram of the circuit shown in FIG. 3A in a second stage.

FIG. 7 is an equivalent circuit diagram of the driving circuit for the pixel unit when the OLED enters the stage for emitting light. FIG. 7 corresponds to the signal ② shown in FIG. 3B.

With reference to FIG. 3A, the third, fourth and fifth thin film transistors T3, T4, and T5 are turned off, and the OLED enters the stage for emitting light.

Let Vp denote the voltage at node P before the third, fourth, and fifth thin film transistors T3, T4 and T5 are turned off, and Vp' denote the voltage at node P after the third, fourth, and fifth thin film transistors T3, T4 and T5 are turned off.

Before the third, fourth, and fifth thin film transistors T3, T4 and T5 are turned off, Vp=Vq=Vg, wherein Vq denotes the voltage at node Q, and Vg denotes the voltage at node G.

Figure 8:
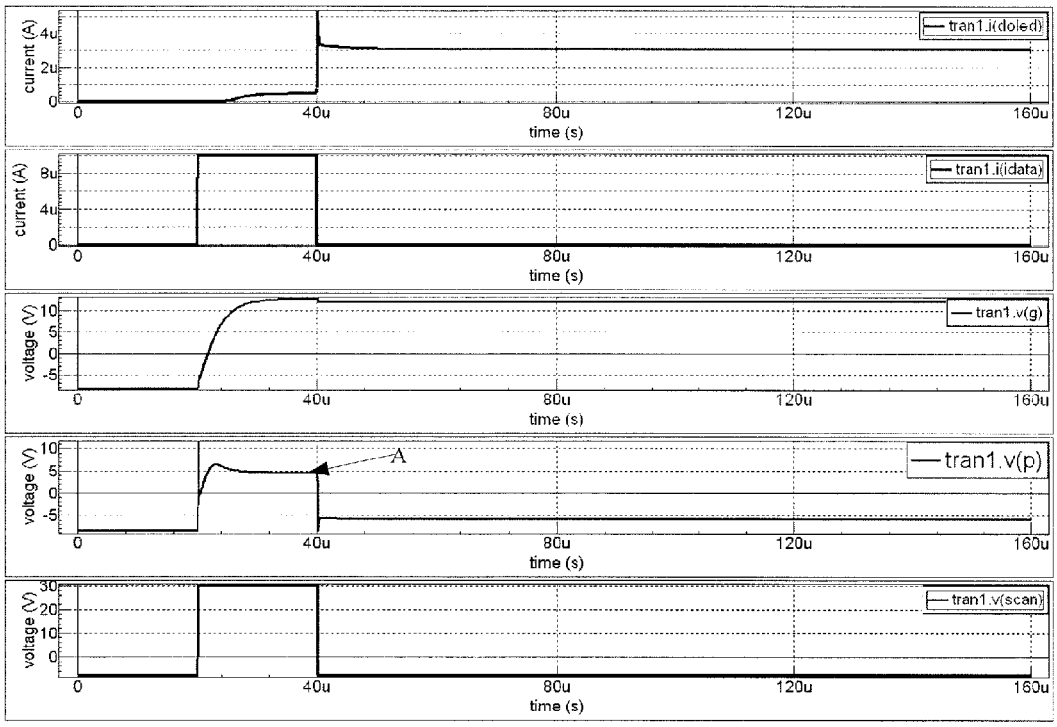
FIG. 8 shows a circuit simulation result of the circuit shown in FIG. 3A in the second stage.

After the third, fourth, and fifth thin film transistors T3, T4 and T5 are turned off, for all the gate voltages of the first, second, and sixth thin film transistors T1, T2 and T6 Vg=Vst, and for both the source voltage of the second thin film transistor T2 and that of the first thin film transistor T1 Vs=VSS, and the drains of the first and second thin film transistors T1 and T2 are connected to the source of the sixth thin film transistor T6 at a connection point, the voltage at which being equal to Vp'. From the above connection relationship, it can be known that, after the third, fourth and fifth transistors T3, T4, and T5 are turned off, the voltage Vp' is pulled down rapidly (refer to the point A shown in FIG. 8), so that the circuit enters another steady operating state.

In the operating state, the voltage at node P decreases to Vg−Vp'≥Vth. For the sixth thin film transistor T6, the following relationship holds true:

$$Vgs = Vg - Vp' \geq Vth \tag{4}$$

Thus, the sixth thin film transistor T6 will be turned on. From the above equation (4), it can be obtained $$Vg \geq Vp' + Vth \tag{5}$$

Further, it can be obtained that $$Vg - VSS \geq Vp' - VSS + Vth \tag{6}$$

At this time, for the sixth thin film transistor T6, Vgs=Vg−Vp', Vds=VDD−Vp', since Vg<VDD, and thus for the sixth thin film transistor T6, Vds>Vgs, in turn Vds>Vgs−Vth. It can be known from the above that the sixth thin film transistor T6 operates in a saturated operating area.

For the first and second thin film transistors T1 and T2, Vgs=Vg−VSS, Vds=Vp'−VSS, thus the following equation holds true for the first thin film transistor T1:

$$Vgs \geq Vds + Vth \tag{7}$$

Therefore, the first thin film transistor T1 operates in a linear operating area, and for the same reason, the second thin film transistor T2 also operates in a linear operating area. It can be known from the above that the first and second thin film transistors T1 and T2 operates in a linear operating area during the stage for the OLED emitting light.

Additionally, since VDD>Vg, VDD−Vp'>Vg−Vp', wherein VDD represents the positive voltage of the voltage source which drives the OLED to emit light.

The following equation can be obtained from the operating state of the first thin film transistor T1:

$$I_{d1} = k_1\left[(V_{gs} - V_{th})V_{p's} - \frac{1}{2}V_{p's}^2\right] \tag{8}$$

The following equation can be obtained from the operating state of the second thin film transistor T2:

$$I_{d2} = k_2\left[(V_{gs} - V_{th})V_{p's} - \frac{1}{2}V_{p's}^2\right] \tag{9}$$

Where $I_{d1}$, $I_{d2}$ represent the drain-source current of T1 and T2 when operating in a linear area respectively.

The equation can be obtained from the above (8) and (9):

$$\frac{I_{d1}}{I_{d2}} = \frac{k_1}{k_2} \tag{10}$$

$$\text{As } I_{oled} = I_{d2} + I_{d1} \tag{11}$$

wherein, Ioled denotes the current flowing through the OLED when the circuit operates, it can be obtained from the above equations (10) and (11):

$$I_{d1} = \frac{k_1 I_{oled}}{k_1 + k_2} \tag{12}$$

It can be obtained from the operating state of T6:

$$I_{oled} = \frac{1}{2}k_6(V_{gp'} - V_{th})^2 \tag{13}$$

The following set of equations can be obtained when the above equations (1), (8) and (13) are combined together:

$$I_{ds1} = \frac{1}{2}k_1(V_{gs} - V_{th})^2 \tag{1}$$

$$I_{d1} = k_1\left[(V_{gs} - V_{th})V_{p's} - \frac{1}{2}V_{p's}^2\right] \tag{8}$$

$$I_{oled} = \frac{1}{2}k_6(V_{gp'} - V_{th})^2 \tag{13}$$

wherein, Vgs denotes the gate-source voltage of the first thin film transistor T1. Since Vgp'=Vgs−Vp's, in other words, in equations (1) and (8), Vp's=Vgs−Vgp', the solution can be obtained by solving the equations (1) and (8):

$$V_{gp'} = \sqrt{\frac{(2I_{ds1} - 2I_{d1})}{k_1}} + V_{th} \quad (14)$$

It can be obtained by substituting (14) into (13):

$$I_{oled} = \frac{k_6(I_{ds1} - I_{d1})}{k_1} \quad (15)$$

It can be obtained by substituting $$I_{ds1} = \frac{k_1 Idata}{k_1 + k_2}$$

and $$I_{d1} = \frac{k_1 I_{oled}}{k_1 + k_2}$$

into (15):

$$\frac{I_{data}}{I_{oled}} = \frac{k_1 + k_2 + k_6}{k_6} \quad (16)$$

Wherein, $k_1$, $k_2$ and $k_6$ represent the constants relating to the design size and the process of the first, second and sixth thin film transistors T1, T2 and T6 respectively.

since $$K = \mu C_{ox} \frac{W}{L}$$

wherein μ,Cox represent the constants relating to the process, W represents the channel width of the TFT, and L represents the channel length of the TFT, wherein W and L can be constants to be optionally designed.

It can be known from the equation (16) that Idata is in direct proportion to Ioled and has a function for amplifying Ioled, and there is a large scale ratio of Idata to Ioled, $$\frac{I_{data}}{I_{oled}} = \frac{k_1 + k_2 + k_6}{k_6}$$

Hence, there is a large value of Idata within the operating range of Ioled, and thus it is possible to charge the storage capacitor Cst rapidly.

On the other hand, since a thin film transistor is not an ideal switch, a certain leak current still exists after the third thin film transistor T3 and the fifth thin film transistor T5 are turned off, and a variation is thus generated in the grey level voltage signal stored in the storage capacitor Cst during the time of one frame due to the existence of the leak current, thus resulting in a variation of the driving current. The driving circuit for the pixel unit provided by the embodiments of the present disclosure has a negative feedback function for the leak current of the storage capacitor Cst to suppress the distortion of the driving current, and the detailed explanation is given as below:

when there is a leak current in the storage capacitor Cst, if the voltage Vg at the node G decreases due to the leak current, while Vp' remains unchanged, Vgp' will decrease. As Vgp' represents the voltage Vgs of the sixth thin film transistor T6, it can be known from the equation (13) that Ioled will decrease, and thus Id1 will decrease naturally as Ioled decreases.

It can be derived from the equation (14)

$$V_{gp'} = \sqrt{\frac{(2I_{ds1} - 2I_{d1})}{k_1}} + V_{th}$$

that Vgp' would increase as Id1 decreases, thus suppressing the decrease of Ioled. Actually, the decrease of the voltage Vg at the node G results in the decrease of Id1, and the decrease of Id1 in turn causes the voltage Vp' at the node P to decrease, thus suppressing the decrease of Vgp'.

It can be seen that, compared to the prior art, the driving circuit for the pixel unit provided by the embodiments of the present disclosure can enable a relatively large scale ratio of the data signal current Idata to the current Ioled flowing through the light-emitting device, which ensures that Ioled is within the range of the operating current of the light-emitting device and Idata can be a relatively large current, thus expediting the speed for charging the storage capacitor. In addition, the driving circuit for the pixel unit provided by the embodiments of the present disclosure further has an excellent negative feedback function for the leak current of the storage capacitor Cst and thus ensures the stable operation of the circuit.

Additionally, an embodiment of the present disclosure further provides a pixel unit including any one of the driving circuits for the pixel unit provided by the embodiments of the present disclosure as above.

Additionally, an embodiment of the present disclosure further provides a display apparatus including the above pixel unit provided by the embodiments of the present disclosure as above.

With reference to the above analysis, it can be seen that, compared to the prior art, the pixel unit and the display apparatus provided by the embodiments of the present disclosure can enable a relatively large scale ratio of the data signal current Idata to the current Ioled flowing through the light-emitting device, which ensures that bled is within the range of the operating current of the light-emitting device, and Idata can be a relatively large current, thus expediting the speed for charging the storage capacitor. In addition, the driving circuit for the pixel unit provided by the embodiments of the present disclosure further has an excellent negative feedback function for the leak current of the storage capacitor Cst and thus ensures the stable operation of the circuit.

The above descriptions have illustrated the preferable embodiments of the present disclosure, and it should be pointed out that those skilled in the art can make several improvements and modifications on the embodiments without departing from the principle of the present disclosure as described, and such improvements and modifications should be considered within the protection scope of the present disclosure.

What is claimed is:

1. A driving circuit for a pixel unit including:

a light-emitting device with a first terminal connected to a first level;

an OLED switching transistor with a drain connected to a second terminal of the light-emitting device;

a first transistor with a drain connected to a source of the OLED switching transistor and a source connected to a second level;

a storage capacitor with a first terminal connected to a gate of the first transistor, a first control node, and a third control node respectively and with a second terminal connected to the second level;

a second transistor with a source connected to the second level and a gate connected to the third control node; and a switching unit, being connected to a data signal terminal for supplying a data signal current, a scan signal terminal for supplying a scan signal, the first control node, the third control node and a drain of the second transistor respectively, and further being connected to the source of the OLED switching transistor via a second control node, for controlling the data signal current to charge the storage capacitor.

2. The driving circuit for the pixel unit as recited in claim 1, wherein, the switching unit comprises a third transistor, a fourth transistor and a fifth transistor, wherein:

the third transistor has a source connected to the third control node, a drain connected to the second control node, and a gate connected to the scan signal terminal;

the fourth transistor has a source connected to the second control node, a drain connected to the data signal terminal, and a gate connected to the scan signal terminal; and the fifth transistor has a source connected to the first control node, a drain connected to the data signal terminal, and a gate connected to the scan signal terminal.

3. The driving circuit for the pixel unit as recited in claim 1, wherein, the first, second, and OLED switching transistors have equal threshold voltages.

4. The driving circuit for the pixel unit as recited in claim 2, wherein, the first, second, third, fourth, fifth and OLED switching transistors are of N type thin film transistors; the first level is a high level, and the second level is a low level; the first terminal of the light-emitting device is an anode of the light-emitting device, and the second terminal of the light-emitting device is a cathode of the light-emitting device; or the first, second, third, fourth, fifth and OLED switching transistors are of P type thin film transistors; the first level is a low level, and the second level is a high level; the first terminal of the light-emitting device is a cathode of the light-emitting device, and the second terminal of the light-emitting device is an anode of the light-emitting device; or the first, second, and OLED switching transistors are of N type thin film transistors, and the third, fourth and fifth transistors are of P type thin film transistors; the first level is a high level, and the second level is a low level; the first terminal of the light-emitting device is an anode of the light-emitting device, and the second terminal of the light-emitting device is a cathode of the light-emitting device; or the first, second, and OLED switching transistors are of P type thin film transistors, and the third, fourth and fifth transistors are of N type thin film transistors; the first level is a high level, and the second level is a low level; the first terminal of the light-emitting device is a cathode of the light-emitting device, and the second terminal of the light-emitting device is an anode of the light-emitting device.

5. The driving circuit for the pixel unit as recited in claim 1, wherein the light-emitting device is an EL or an OLED.

6. A driving method for a pixel unit, which is applied to the driving circuit for the pixel unit as recited in claim 1, and the driving method comprising:

step for charging the pixel unit: turning on a switch for controlling the data signal current to charge the storage capacitor until the voltage across the storage capacitor does not rise any more;

step for the light-emitting device emitting light: turning off the switch for controlling the data signal current, and turning on a switch for controlling the light-emitting device to make the light-emitting device to emit light, wherein the current flowing through the light-emitting device is in direct proportion to the data signal current.

7. The driving method for the pixel unit as recited in claim 6, wherein, the current flowing through the light-emitting device is equal to the sum of the current flowing through the first transistor and that flowing through the second transistor in the driving circuit for the pixel unit.

8. A pixel unit, characterized in that it includes the driving circuit for pixel unit as recited in claim 1.

9. The pixel unit of claim 8, wherein, the switching unit comprises a third transistor, a fourth transistor and a fifth transistor, wherein:

the third transistor has a source connected to the third control node, a drain connected to the second control node, and a gate connected to the scan signal terminal;

the fourth transistor has a source connected to the second control node, a drain connected to the data signal terminal, and a gate connected to the scan signal terminal; and the fifth transistor has a source connected to the first control node, a drain connected to the data signal terminal, and a gate connected to the scan signal terminal.

10. The pixel unit of claim 8, wherein, the first, second, and OLED switching transistors have equal threshold voltages.

11. The pixel unit of claim 9, wherein, the first, second, third, fourth, fifth and OLED switching transistors are of N type thin film transistors; the first level is a high level, and the second level is a low level; the first terminal of the light-emitting device is an anode of the light-emitting device, and the second terminal of the light-emitting device is a cathode of the light-emitting device; or the first, second, third, fourth, fifth and OLED switching transistors are of P type thin film transistors; the first level is a low level, and the second level is a high level; the first terminal of the light-emitting device is a cathode of the light-emitting device, and the second terminal of the light-emitting device is an anode of the light-emitting device; or the first, second, and OLED switching transistors are of N type thin film transistors, and the third, fourth and fifth transistors are of P type thin film transistors; the first level is a high level, and the second level is a low level; the first terminal of the light-emitting device is an anode of the light-emitting device, and the second terminal of the light-emitting device is a cathode of the light-emitting device; or the first, second, and OLED switching transistors are of P type thin film transistors, and the third, fourth and fifth transistors are of N type thin film transistors; the first level is a high level, and the second level is a low level; the first terminal of the light-emitting device is a cathode of the light-emitting device, and the second terminal of the light-emitting device is an anode of the light-emitting device.

12. The pixel unit of claim 8, wherein the light-emitting device is an EL or an OLED.

* * * * *